US007938460B2

(12) United States Patent
Ishiguro

(10) Patent No.: US 7,938,460 B2
(45) Date of Patent: May 10, 2011

(54) LATCH RELEASE OPERATING APPARATUS

(75) Inventor: Katsuyuki Ishiguro, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 341 days.

(21) Appl. No.: 11/432,504

(22) Filed: May 12, 2006

(65) Prior Publication Data

US 2006/0279095 A1 Dec. 14, 2006

(30) Foreign Application Priority Data

Jun. 7, 2005 (JP) ..... 2005-166744

(51) Int. Cl.
*E05C 3/00* (2006.01)
*H01H 9/04* (2006.01)

(52) U.S. Cl. ..... 292/336.3; 292/DIG. 37; 200/302.1; 200/302.2; 200/306

(58) Field of Classification Search ..... 292/336.3, 292/DIG. 37; 200/302.1, 302.2, 306
See application file for complete search history.

(56) References Cited

U.S. PATENT DOCUMENTS

| | | | | | |
|---|---|---|---|---|---|
| 3,046,591 | A | * | 7/1962 | Prohaska et al. | 15/250.02 |
| 3,917,917 | A | * | 11/1975 | Murata | 200/517 |
| 4,716,262 | A | * | 12/1987 | Morse | 200/5 A |
| 4,760,217 | A | * | 7/1988 | Suzuki et al. | 200/5 A |
| 4,861,950 | A | * | 8/1989 | Yanai et al. | 200/5 R |
| 5,137,312 | A | * | 8/1992 | Tang | 292/336.3 |
| 5,181,166 | A | * | 1/1993 | Howell | 361/659 |
| 5,258,592 | A | * | 11/1993 | Nishikawa et al. | 200/302.2 |
| 5,734,136 | A | * | 3/1998 | Newcomer et al. | 200/5 A |
| 6,239,391 | B1 | * | 5/2001 | Nishijima et al. | 200/5 A |
| 6,626,473 | B1 | * | 9/2003 | Klein et al. | 292/347 |
| 6,740,834 | B2 | | 5/2004 | Sueyoshi et al. | |
| 6,956,180 | B1 | * | 10/2005 | Su et al. | 200/302.3 |
| 6,963,039 | B1 | * | 11/2005 | Weng et al. | 200/302.1 |
| 7,057,124 | B2 | * | 6/2006 | Ieda et al. | 200/61.62 |
| 7,230,195 | B2 | * | 6/2007 | Ohnishi | 200/302.1 |
| 7,244,897 | B2 | * | 7/2007 | Villagrasa et al. | 200/61.85 |
| 7,273,991 | B2 | * | 9/2007 | Korultay et al. | 200/61.62 |
| 7,442,892 | B2 | * | 10/2008 | Ishiguro | 200/329 |

FOREIGN PATENT DOCUMENTS

| | | | |
|---|---|---|---|
| DE | 4208087 | * | 4/1993 |
| JP | 5-11243 | | 2/1993 |
| JP | 6-14380 | U | 2/1994 |
| JP | 10-82216 | A | 3/1998 |
| JP | 2001-248345 | A | 9/2001 |
| JP | 2003-221949 | A | 8/2003 |
| JP | 2004-47255 | A | 2/2004 |

* cited by examiner

*Primary Examiner* — Carlos Lugo
(74) *Attorney, Agent, or Firm* — Foley & Lardner LLP

(57) ABSTRACT

A latch release operating apparatus release a latch state of a door, for example, a vehicle door. The apparatus includes an enclosure. The enclosure includes a case having a hollow portion; a base plate arranged in the hollow portion, the base plate having an electrically conducting portion; a member made of electrically non-conducting material arranged at the electrically conducting portion of the base plate; and a cover for closing the hollow portion. At least one of the case and the cover is provided with a breathing hole so that an interior of the enclosure communicates with an exterior of the enclosure.

4 Claims, 14 Drawing Sheets

PRIOR ART

LATCH RELEASE OPERATING APPARATUS

BACKGROUND OF THE INVENTION

1. Field of the Invention

The present invention relates to a latch release operating apparatus that is operated to release a latch state of a door.

2. Description of the Related Art

Recently, some vehicles have a release actuator that is driven to release a latched state of a door, such as a trunk lid.

A latch release operating apparatus that has a switching unit for driving the release actuator is generally employed in such vehicles.

In one type of such latch release operating apparatus, an enclosure 3, arranged from a case 1 and a cover 2, is mounted onto a door outer panel P via a base member (mounting member) 4 in a manner such that an operating portion 2*a* protrudes outward from an opening 4*a* of the base member 4 as shown in FIG. 17. A switching unit 6 is disposed inside the enclosure 3, and the switching unit 6 is turned on when the operating portion 2*a* is depressed.

When an operator depresses the operating portion 2*a* thereby turning on the switching unit 6, the release actuator is driven and a door latch apparatus undergoes a release operation. Therefore, the operation can be performed in lesser operating force than in comparison with a conventional latch release operating apparatus that is arranged to release a door latch apparatus via a wire cable and a link rod.

However, such latch release operating apparatus requires adequate waterproofing measures. Presently, in conventional vehicles, the waterproofing is achieved by the following arrangement. That is, the cover 2 is formed from a resin material that has waterproofing and elastic properties, the opening 1*a* on the upper surface of the case 1 is covered by the cover 2, and the enclosure 3 is mounted onto the base member 4 while pressing the cover 2 against the base member 4 in a manner such that the operating portion 2*a* protrudes outward from the opening 4*a* of the base member 4. Rainwater, carwash water, and other water are thus prevented from entering inside the enclosure 3 from a front side.

Furthermore, a packing 7 is disposed between the base member 4 and the door outer panel P, and the packing 7 prevents water from entering into the inner side of the door outer panel P from between the door outer panel P and the base member 4. Water is thus prevented from entering inside the enclosure 3 from a back side.

Thus, with the latch release operating apparatus, water is prevented from entering inside the enclosure 3 from the front and back sides, and water is thus prevented from contacting an electrically conducting portion of a base plate 8 disposed inside the enclosure 3.

Recently, the standardization of latch release operating apparatuses and the mounting of such standardized latch release operating apparatuses onto various vehicles have been desired to reduce costs.

Desirably, such a latch release operating apparatus can be mounted onto various locations without causing a malfunction. That is, desirably, such a latch release operating device can be mounted, without causing a malfunction, even onto a vehicle, with which the packing 7 cannot be installed between the base member 4 and the door outer panel P.

However, when the conventional latch release operating apparatus is applied to a vehicle, with which the packing 7 cannot be installed between the base member 4 and the door outer panel P, water may enter inside the enclosure 3 from the back side and the water that has entered inside the enclosure 3 may contact the electrically conducting portion of the base plate 8 to cause a malfunction of the apparatus.

Though the enclosure 3 can be made to be a watertight structure to prevent the entry of water inside the enclosure 3 from the back side, this arrangement cannot be employed due to the following problem.

That is, when the enclosure is made a watertight structure, air cannot be released from the interior of the enclosure to the exterior of the enclosure and air cannot flow from the exterior of the enclosure into the interior of the enclosure. Thus, when the vehicle is moved from a specific locality to a colder locality, the air inside the enclosure contracts to cause the resistance against the depression of the operating portion 2*a* to become small and thus change the operational feeling. On the other hand, when the vehicle is moved from the specific locality to a warmer locality, because the air inside the enclosure expands, the resistance against the depression of the operating portion 2*a* increases and the operational feeling is thus changed.

SUMMARY OF THE INVENTION

It is an object of the present invention to at least solve the problems in the conventional technology.

According to an aspect of the present invention, a latch release operating apparatus for releasing a latch state of a door, includes an enclosure including a case having a hollow portion; a base plate arranged in the hollow portion, the base plate having an electrically conducting portion; a member made of electrically non-conducting material arranged at the electrically conducting portion of the base plate; and a cover for closing the hollow portion. At least one of the case and the cover is provided with a breathing hole so that an interior of the enclosure communicates with an exterior of the enclosure.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a latch release operating apparatus according to the present invention will now be explained in detail with reference to the accompanying drawings.

Figure 1:
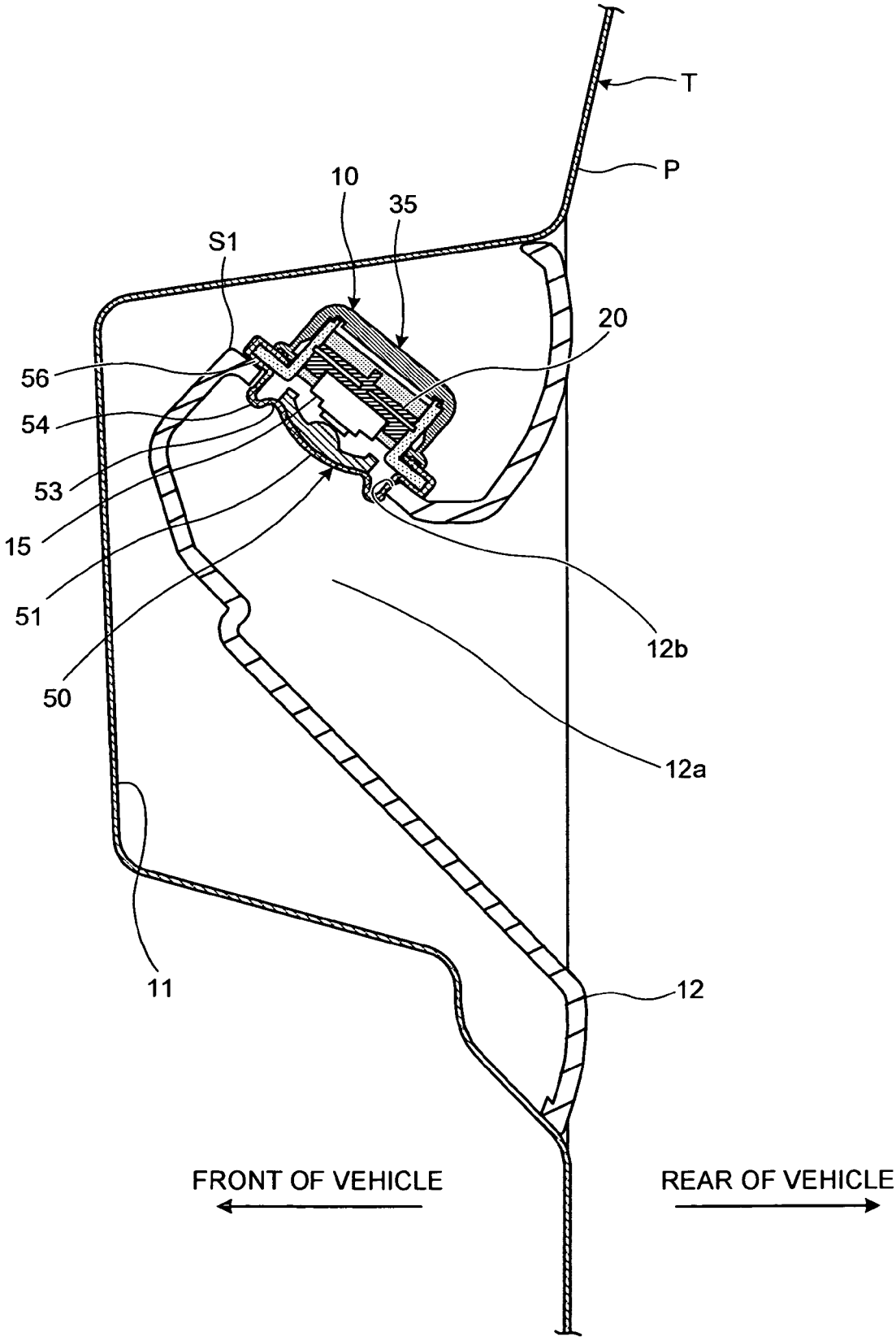
FIG. 1 is a sectional side view of principal portions of a vehicle to which a latch release operating apparatus according to an embodiment of the present invention is applied.

FIG. 1 is a diagram of principal portions of a vehicle to which a latch release operating apparatus 10 according to an embodiment of the present invention is applied. The latch release operating apparatus is for opening and closing a trunk room of a four-wheel vehicle or other vehicle.

The latch release operating apparatus 10 is disposed in an apparatus recess 11 provided in a door outer panel P, for example, of a trunk lid (door) T and is mounted onto the door outer panel P via a base member (mounting member) 12.

The apparatus recess 11 is recessed towards a front side of the vehicle. The base member 12 is formed of resin so as to close the apparatus recess 11 and has an operating recess 12*a*, a mounting opening 12*b*, and screw-on projections.

Figure 2:
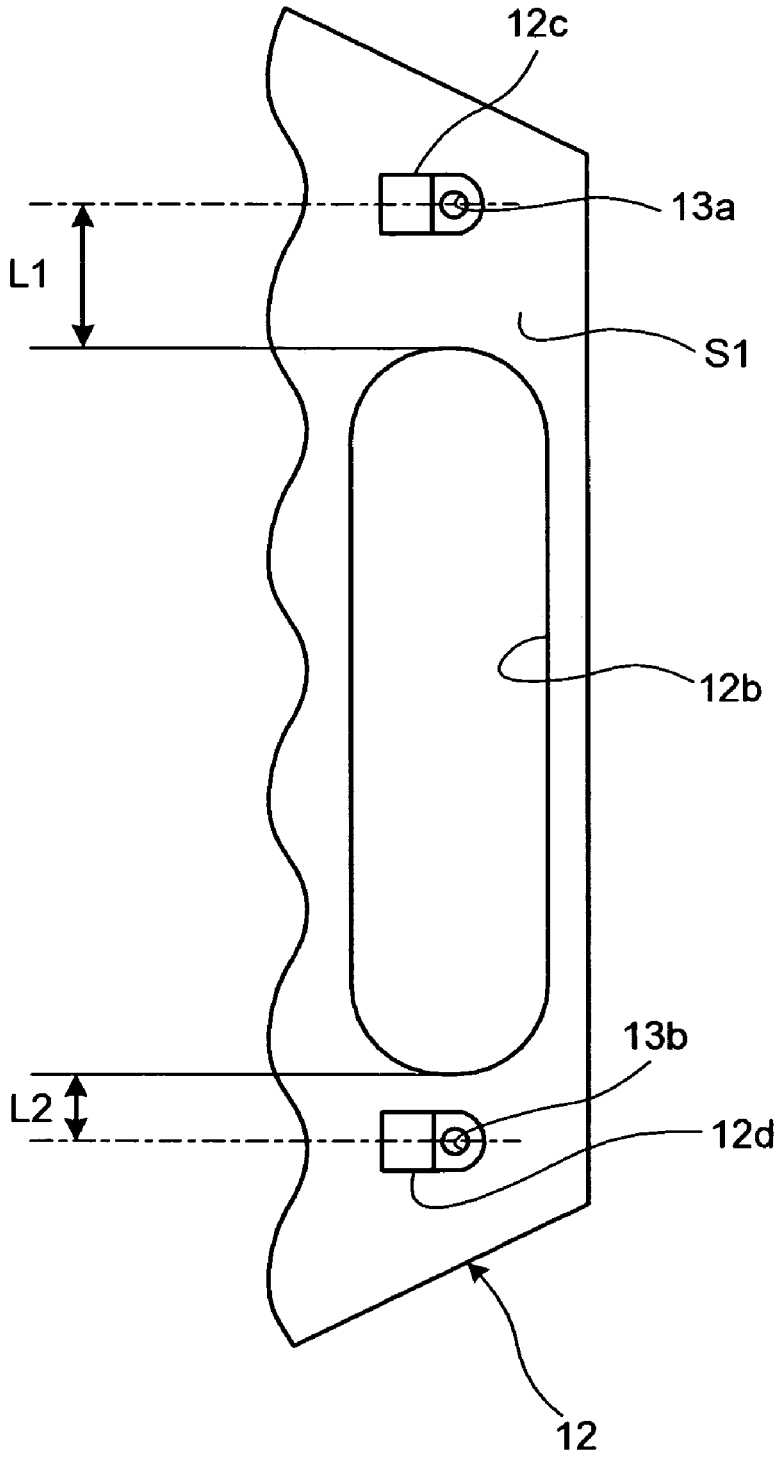
FIG. 2 is a diagram for explaining a portion of a base member included on the vehicle.

The operating recess 12*a* is formed in an upwardly inclining manner. The mounting opening 12*b* is formed in the base member 12 so as to be positioned at an upper portion of the operating recess 12*a* as shown in FIGS. 1 and 2. The mounting opening 12*b* is formed to be long and thin along a width direction of the vehicle and is of a size that enables insertion of a lip, a groove, and an operating portion of a cover to be explained below and enables a front surface of a peripheral portion of the cover to contact an inner surface S1 of the base member 12.

Screw-on projections 12*c* and 12*d* include screw holes 13*a* and 13*b*, respectively, and are disposed so as to sandwich mounting opening 12*b*. When L1 is a distance from a center of the one screw hole 13*a* at the upper side in FIG. 2 to one end of the mounting opening 12*b* and L2 is a distance from a center of the other screw hole 13*b* at the lower side in FIG. 2 to the other end of the mounting opening 12*b*, the distance L1 from the center of the one screw hole to the one end of the mounting hole is greater than the distance L2 from the other screw hole to the other end of mounting opening 12*b*.

As shown in FIGS. 3 to 6, the latch release operating apparatus 10 includes a switching unit 15, a base plate 20, a case 35, and a cover 50. An enclosure 70 is arranged from the case 35 and the cover 50, and the switching unit 15 and the base plate 20 are disposed inside the enclosure 70.

The switching unit 15 is a so-called tact switch and includes a main switch body 16 and a pushbutton 17. With the switching unit 15 of the present embodiment, the main switch body 16 has a thin, substantially square outer shape and the pushbutton 17 of thin, cylindrical shape protrudes from an upper surface of the main switch body 16.

The switching unit 15 is normally maintained in the off state and is turned on when the pushbutton 17 is depressed with respect to the main switch body 16. When the force of depressing the pushbutton 17 is thereafter removed, the pushbutton 17 is restored to its original state by the action of a built-in return spring (not shown) and the switching unit 15 is thereby put in the off state again.

As shown in FIGS. 7 to 12, the base plate 20 is formed as a plate having a first semicircular portion 21, a rectangular portion 22, and a second semicircular portion 23. The base plate 20 includes a first leg 24, a second leg 25, a third leg 26, a fourth leg 27, a fifth leg 28, a switch mounting portion 29, and protective walls 30.

Figure 6:
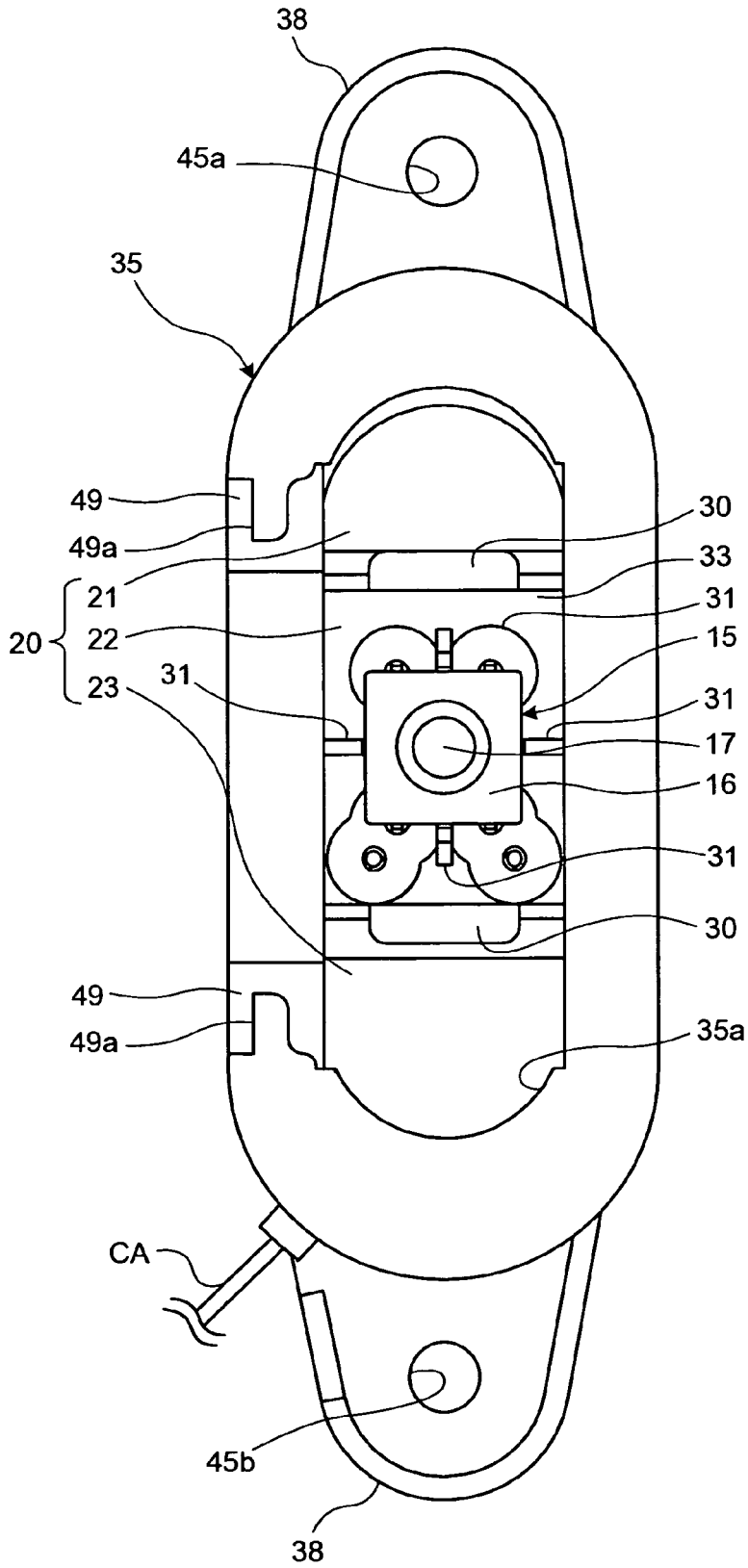
FIG. 6 is a front view of a state in which a cover of the latch release operating apparatus has been removed.
Figure 7:
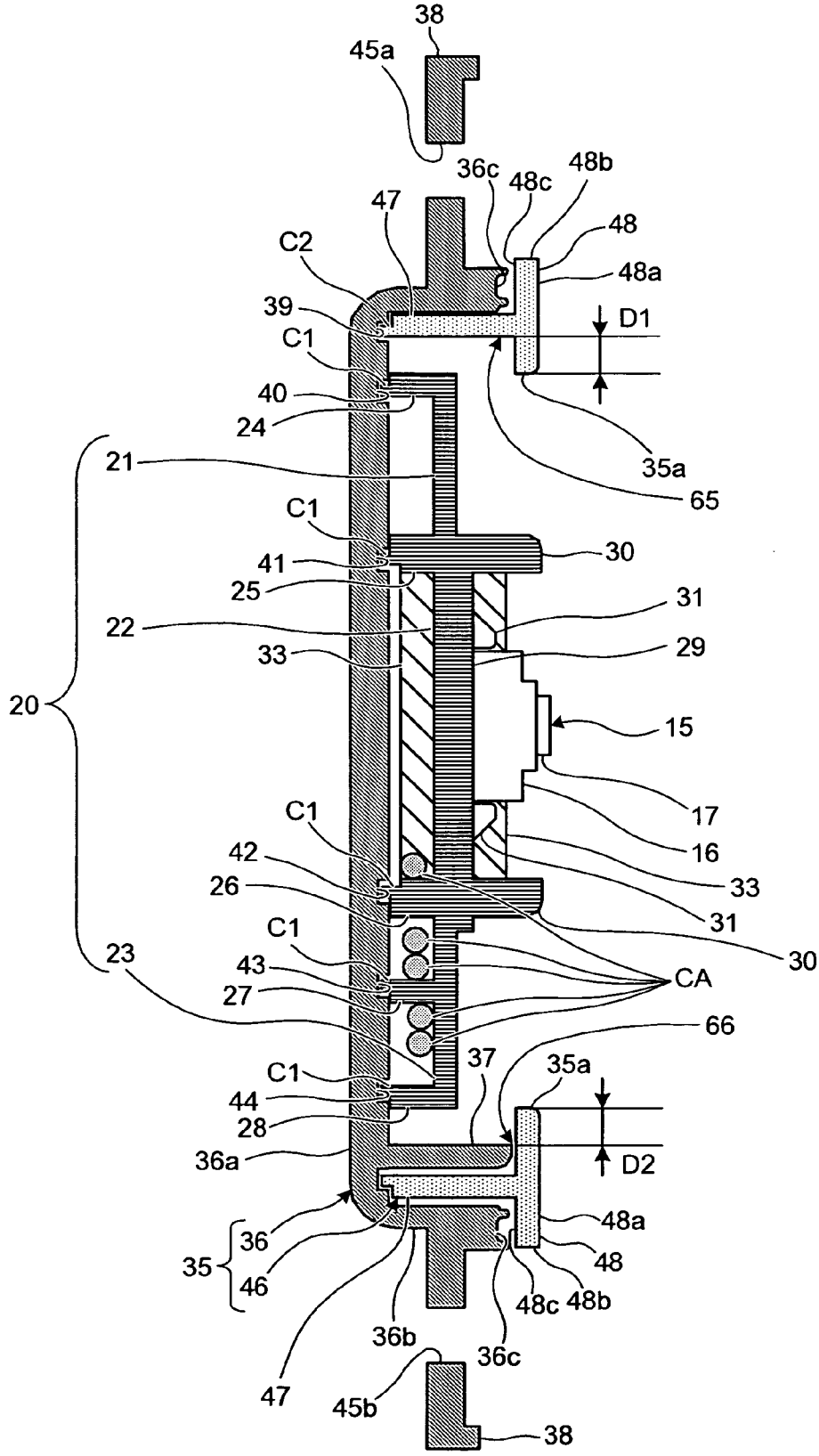
FIG. 7 is a sectional view of a case of the latch release operating apparatus.

The first semicircular portion 21 is positioned at an upper side in FIG. 7, and is formed as a semicircular shape as shown in FIG. 6. The rectangular portion 22 is positioned at the center in FIG. 7, and is formed as a rectangular shape continuous with the first semicircular portion 21 as shown in FIG. 6. The second semicircular portion 23 is positioned at a lower side in FIG. 7 and is formed as a semicircular shape continuous with the rectangular portion 22 as shown in FIG. 6.

As shown in FIGS. 7 to 12, each of the legs 24, 25, 26, 27, and 28 has an engaging claw C1 at a front end and protrudes to a back surface of the base plate 20. The first leg 24 is formed along an edge of the first semicircular portion 21 and is arcuate as viewed from the bottom.

The second leg 25 is formed at a predetermined interval from the first leg 24 and takes the form of a straight line as viewed from the bottom.

The third leg 26 is formed at a predetermined interval from the second leg 25 and takes the form of a straight line as viewed from the bottom. The third leg 26 is provided with a cable insertion hole H1.

The fourth leg 27 is formed at a predetermined interval from the third leg 26 and takes the form of a straight line as viewed from the bottom. A cutout H2 for cable insertion is provided at one end of the fourth leg 27.

The fifth leg 28 is formed along an edge of the second semicircular portion 23 and is arcuate as viewed from the bottom. A cutout H3 for cable insertion is provided at the other end of the fifth leg 28.

The switch mounting portion 29 is positioned at substantially the center of the base plate 20 and is the portion onto which the switching unit 15 is mounted.

The length and width of the switch mounting portion 29 are slightly greater than the length and width of the main switch body 16 of the switching unit 15. Though not illustrated in the figures, terminal through holes, for passing terminals of the switching unit 15 to the back surface of the base plate 20, are formed at suitable portions of the switch mounting portion 29.

The switch mounting portion 29 is provided with four positioning ribs 31 that protrude from the front surface of the base plate 20 and surround the switch mounting portion 29 as shown in FIG. 6.

The positioning ribs 31 contact the periphery of the main switch body 16 to position the switching unit 15 with respect to the base plate 20.

The protective walls 30 are positioned near the switch mounting portion 29 so as to sandwich the switch mounting portion 29 from the upper and lower sides in FIG. 6. As shown in FIG. 7, the protective walls 30 protrude toward the front surface of the base plate 20. The length of protrusion of each protective wall 30 with respect to the base plate 20 is slightly shorter than the length of protrusion of the pushbutton 17 with respect to the base plate 20.

The case 35 is formed from a comparatively hard synthetic resin with an electrical insulating property and includes a main case body 36 and a collar 46 as shown in FIG. 7.

Figure 13:
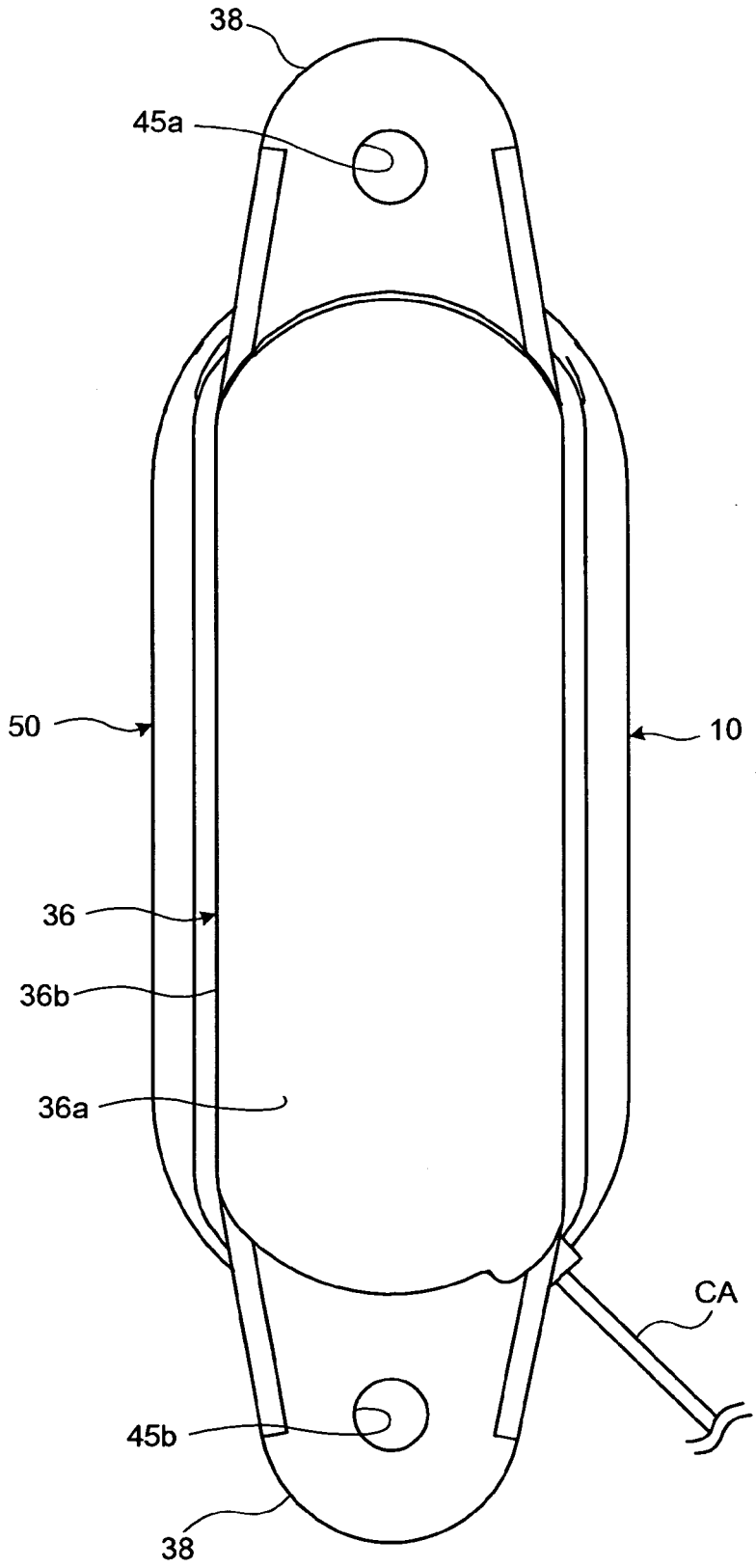
FIG. 13 is a rear view of the latch release operating apparatus.

The main case body 36 has a box-like form, with the length in the up/down direction being made longer than the length in the left/right direction as shown in FIG. 13 to improve the operability of an operating portion of the cover 50 as will be explained later, and includes an opening at an upper surface for receiving the base plate 20 into the interior. The main case body 36 has an engagement wall 37 in its interior and has two tongues 38 at its exterior as shown in FIG. 7.

Figure 9:
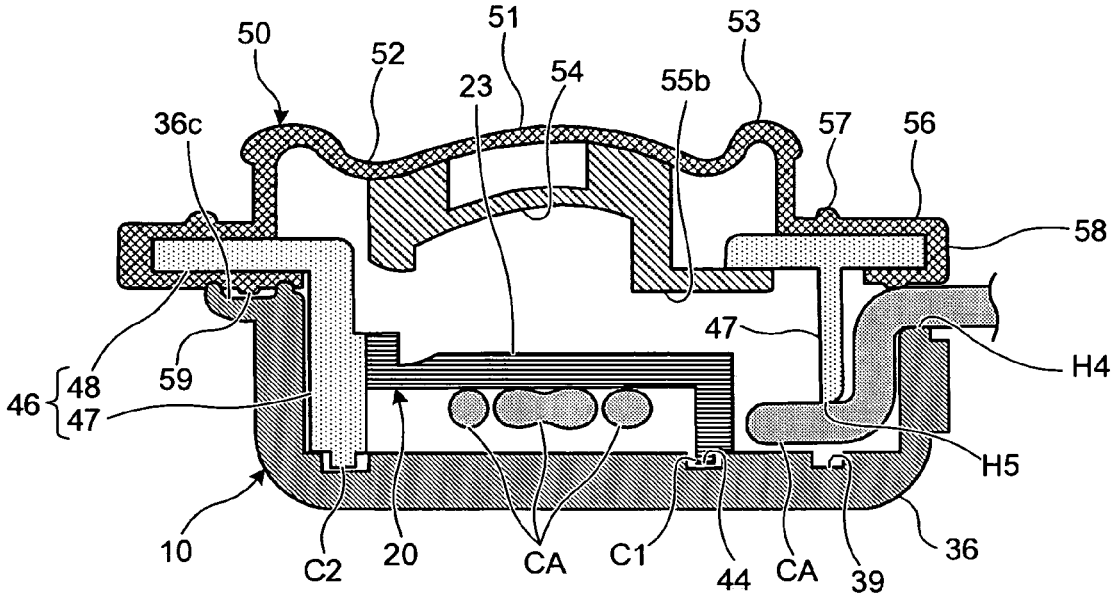
FIG. 9 is a sectional view taken along line II-II of FIG. 8.
Figure 10:
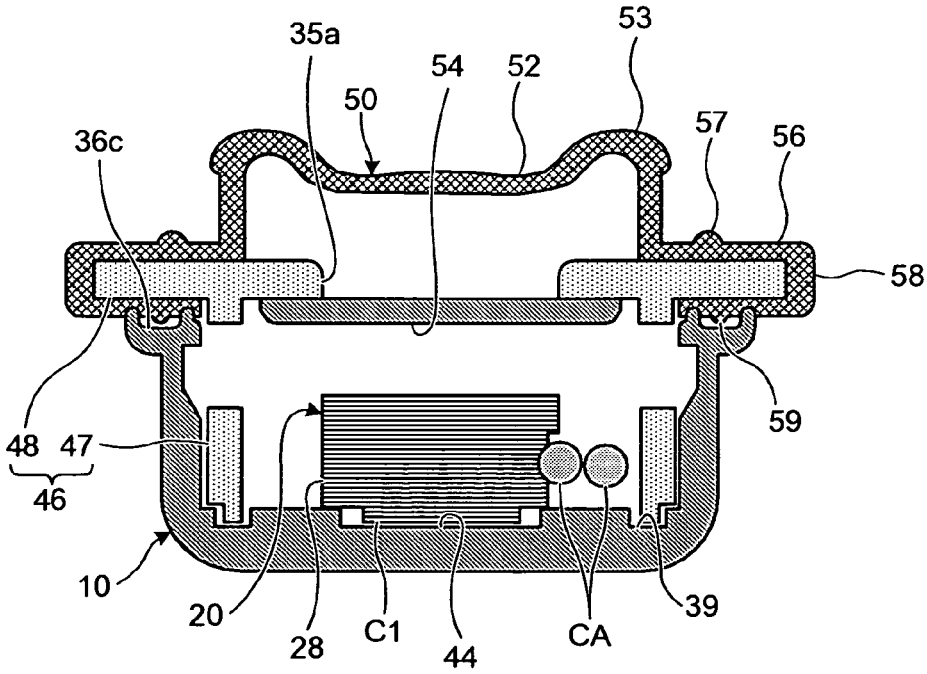
FIG. 10 is a sectional view taken along line III-III of FIG. 8.

At an upper end of a side wall 36*b* of the main case body 36, an engagement groove 36*c* is formed along a periphery of an opening. The side wall 36*b* of the main case body 36 is provided with a cutout H4 for cable insertion that allows a cable CA to extend from the interior of the enclosure 70 to the exterior of the enclosure 70 as shown in FIG. 9.

As shown in FIG. 7, a peripheral engagement groove 39, a first engagement groove 40, a second engagement groove 41, a third engagement groove 42, a fourth engagement groove 43, and a fifth engagement groove 44 are formed in a bottom wall 36*a* in the interior of the main case body 36. The peripheral engagement groove 39 is formed along the edges of the bottom wall 36*a*.

The first engagement groove 40 is formed to be arcuate in plan view so as to correspond to the first leg 24 of the base plate 20.

The second engagement groove 41 is formed to be a straight line in plan view so as to correspond to the second leg 25 of the base plate 20.

The third engagement groove 42 is formed to be a straight line in plan view so as to correspond to the third leg 26 of the base plate 20.

The fourth engagement groove 43 is formed to be a straight line in plan view so as to correspond to the fourth leg 27 of the base plate 20.

The fifth engagement groove 44 is formed to be arcuate in plan view so as to correspond to the fifth leg 28 of the base plate 20.

The engagement wall 37 protrudes upward from the bottom wall 36*a* and is formed along the side wall 36*b*.

The tongues 38 are formed so as to extend in a direction orthogonal to the side wall 36*b* of the main case body 36. Through holes 45*a* and 45*b* that pass through the tongues 38 are formed in the tongues 38 as shown in FIGS. 7 and 13.

Figure 12:
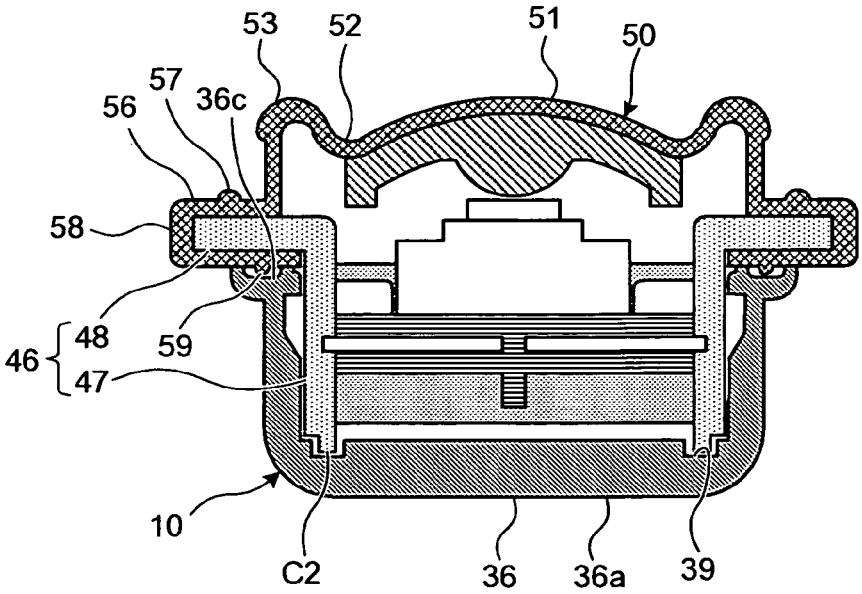
FIG. 12 is a sectional view taken along line V-V of FIG. 8.

The collar 46 is formed from a comparatively hard synthetic resin with an electrical insulating property and includes a first plate-like member 47 and a second plate-like member 48 as shown in FIG. 12.

Figure 8:
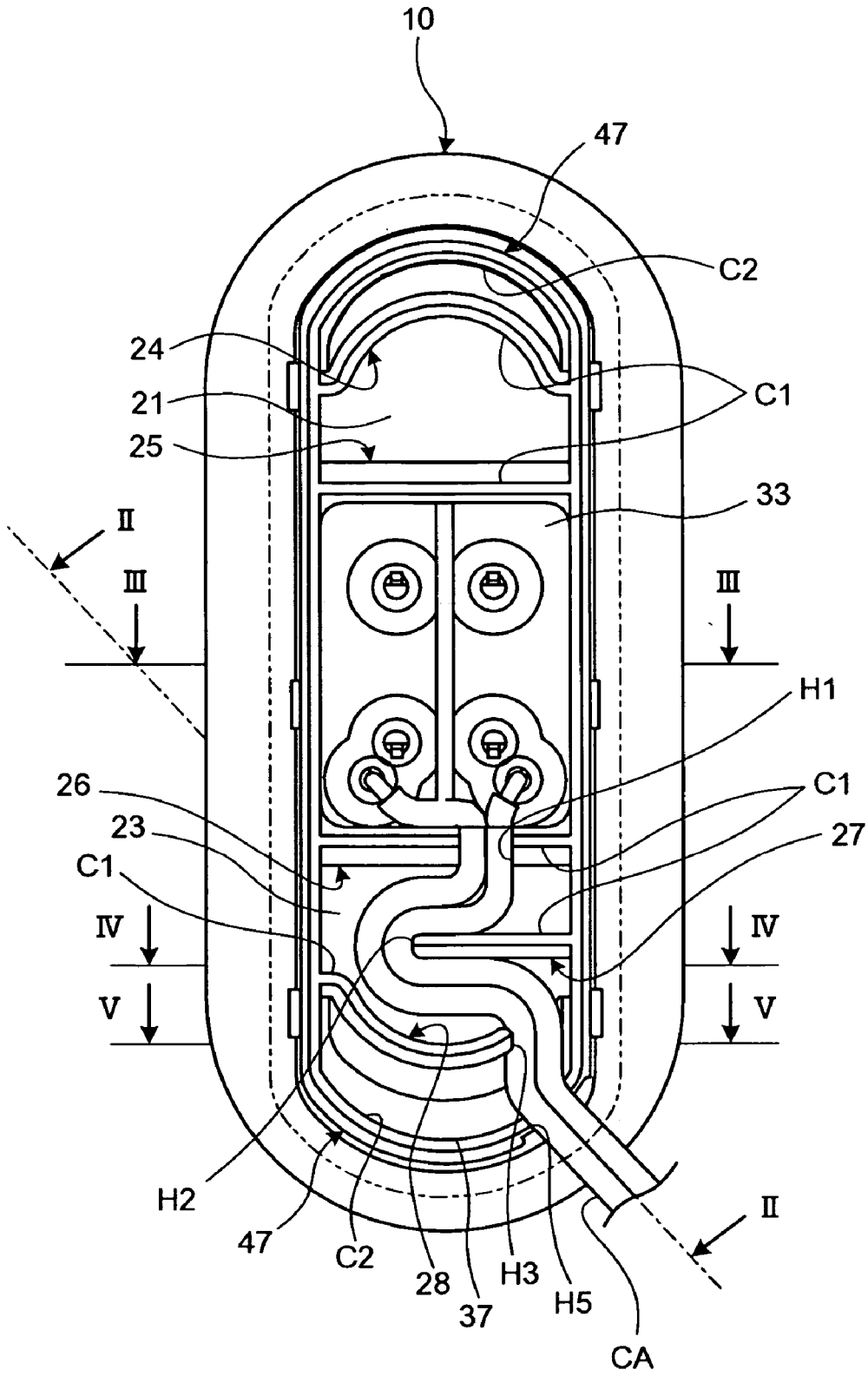
FIG. 8 is a diagram for explaining the interior of the latch release operating apparatus.

The first plate-like member 47 is formed to a plate-like shape that extends along the peripheral engagement groove 39 of the bottom wall 36*a* and includes an engaging claw C2, at the front end thereof, that engages with the peripheral engagement groove 39. As shown in FIGS. 8 and 9 a cutout H5 for cable insertion is provided in the first plate-like member 47.

As shown in FIG. 12, the second plate-like member 48 is formed to a plate-like shape that extends in a direction orthogonal to the first plate-like member 47 from one end of the first plate-like member 47. The collar 46 formed from the first plate-like member 47 and the second plate-like member 48 has a T-like cross-section in the length direction of the main case body 36 and has an L-like cross-section in the width direction of the main case body 36.

As shown in FIG. 6, two breathing grooves 49 that cut across the second plate-like member 48 are formed in the second plate-like member 48. At the middle of each breathing groove 49 is provided a trap 49*a* that reduces the area of the breathing groove 49.

In the present embodiment, the collar 46 and the base plate 20 are formed integrally.

A method of assembling together the portion, in which the collar 46 and the base plate 20 are formed integrally, the switching unit 15, and the case 35 will now be explained.

After mounting the switching unit 15 onto the switch mounting portion 29 of the base plate 20 while performing positioning by the positioning ribs 31 shown in FIG. 7, a space surrounded by the front surface of the base plate 20, the first plate-like member 47 of the collar 46, and the two protective walls 30 is filled with a sealing material so as to cover a lower half of the main switch body 16. Thereafter, the sealing material is cured to provide a sealing member 33 that seals an electrically conducting portion at the front surface of the base plate 20, and by the sealing member 33, the switching unit 15 is attached to the base plate 20. The sealing material is, for example, a resin having an electrical insulating property and a waterproof property.

Figure 4:
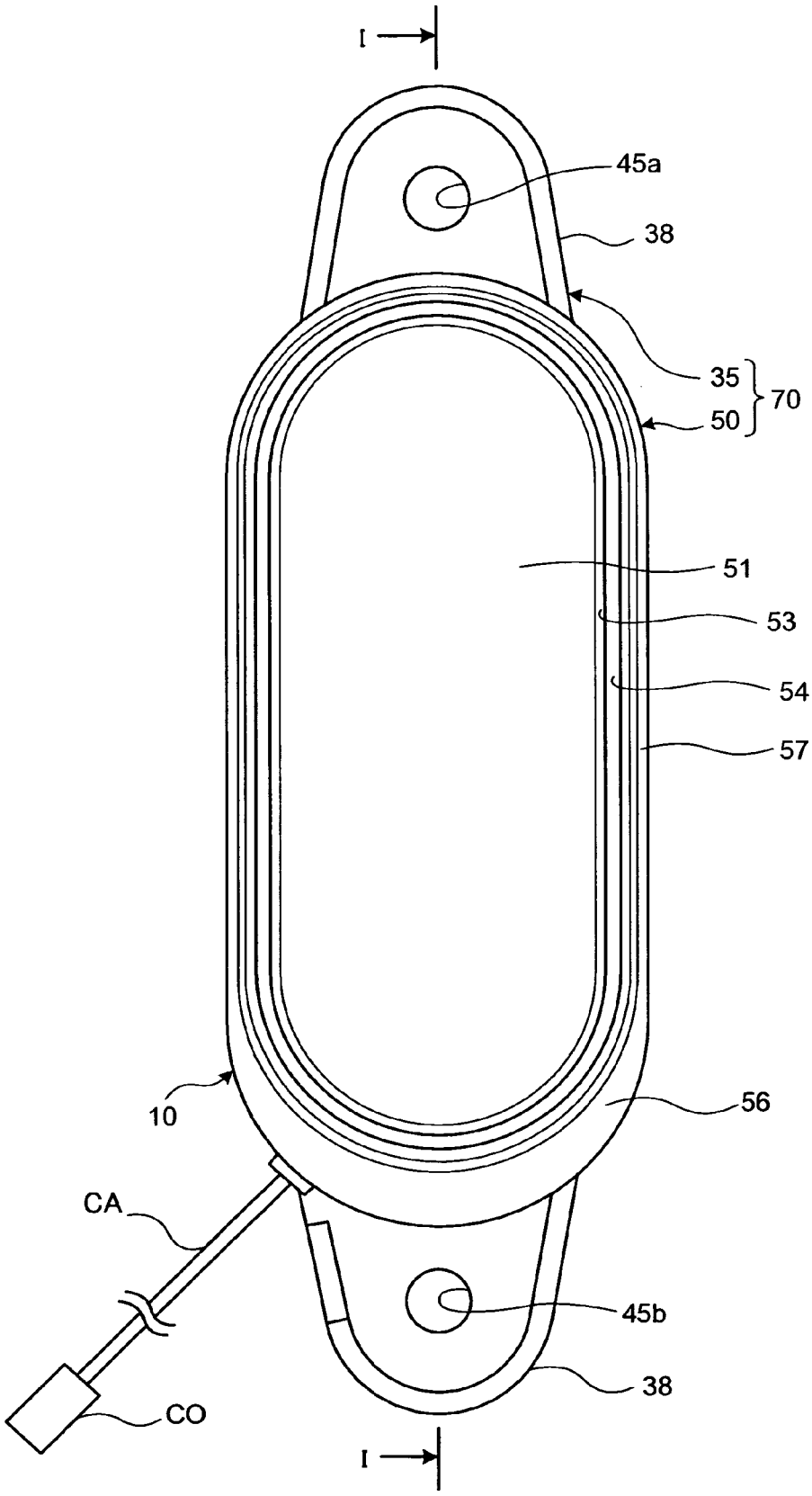
FIG. 4 is a front view of the latch release operating apparatus.

One end of the cable CA, with an outer sheath being removed partially, is passed through the cable insertion cutout H5 formed in the first plate-like member 47, the cutout H3 formed in the fifth leg 28, the cutout H2 formed in the fourth leg 27, and the cable insertion hole H1 formed in the third leg 26 and then connected by solder to terminals at the back surface of the base plate 20. By connecting the cable CA at one end to the terminals at the back surface of the base plate 20, the terminals are electrically connected to a connector CO attached to the other end of the cable CA as shown in FIG. 4.

A space, shown in FIG. 7, that is surrounded by the back surface of the base plate 20, the first plate-like member 47 of the collar 46, the second leg 25, and the third leg 26 is then filled with the same sealing resin as the above so as to cover the terminals at the back surface of the base plate 20. Thereafter, the sealing material is cured to provide the sealing member 33 that seals the terminals of the switching unit 15, the solder, and other electrically conducting portions at the back surface of the base plate 20. Thus, with the latch release operating apparatus 10, the electrically conducting portions at the front surface and the back surface of the base plate 20 are sealed by the sealing members 33.

Then after passing the cable CA through the cable insertion cutout H5 formed in the main case body 36, the engaging grooves 40, 41, 42, 43, and 44 formed in the bottom wall 36*a* of the main case body 36 are engaged correspondingly with the engaging claws C1 provided on the legs 24, 25, 26, 27, and 28 of the base plate 20. By then mounting the collar 46 and the base plate 20 onto the main case body 36 so that the peripheral engagement groove 39, formed in the bottom wall 36*a* of the main case body 36, engages with the engaging claw C2 provided on the collar 46, the integral portion of the base plate 20 and the collar 46 is mounted onto the main case body 36 and the case 35 is thus arranged. An opening 35*a* that is long in the length direction of the main case body 36 and short in the width direction is included in the upper surface of the case 35 that is thus arranged.

As shown in FIG. 7, with the case 35, when D1 is a depth of a first engagement recess 65, positioned at one end of the opening 35*a* and arranged from the first plate-like member 47 and the second plate-like member 48, and D2 is a depth of a second engagement recess 66, positioned at the other end of the opening 35*a* and arranged from the engagement wall 37 and the second plate-like member 48, the depth D1 of the first engagement recess is made shallower than the depth D2 of the second engagement recess.

Figure 14:
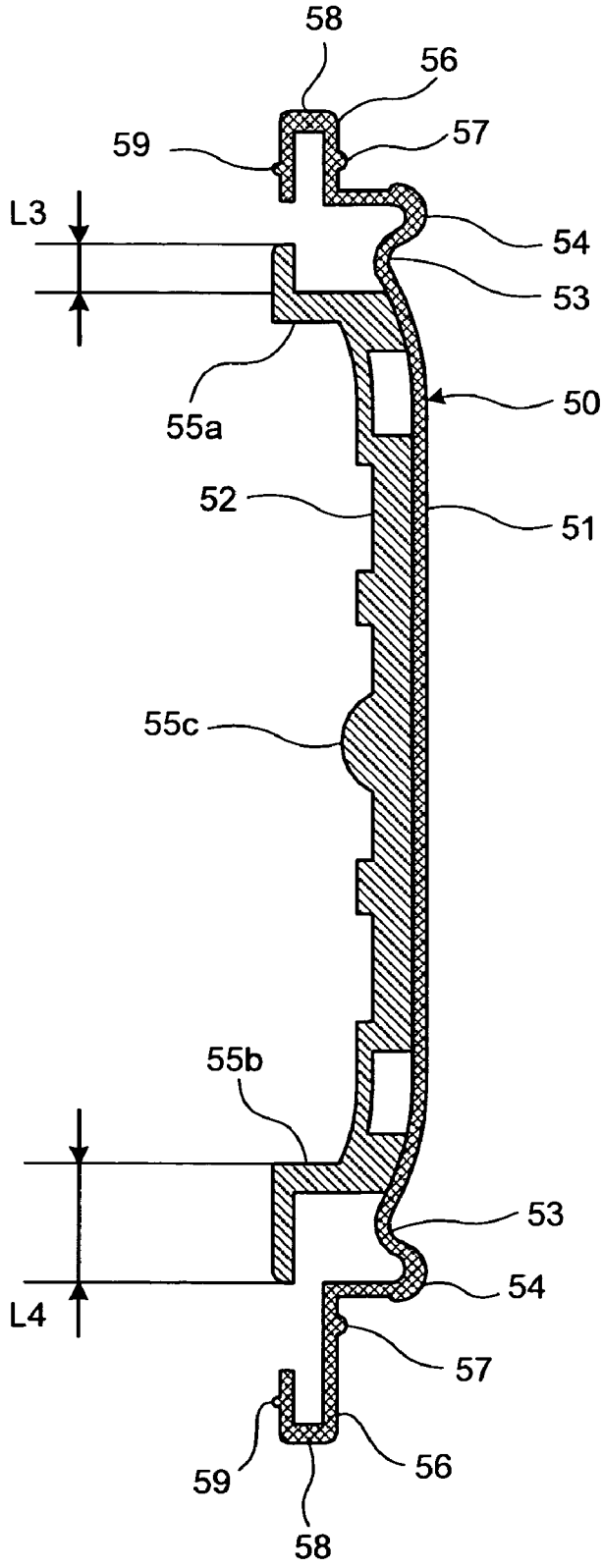
FIG. 14 is a sectional view of the cover included on the latch release operating apparatus.

The arrangement of the cover 50 will now be explained. As shown in FIG. 14, the cover 50 includes an operating portion 51, a back plate 52, a groove 53, a lip 54, a peripheral portion 56, and a mounting portion 58. The operating portion 51, the groove 53, the lip 54, the peripheral portion 56, and the mounting portion 58 are formed from a material, such as ethylene-propylene rubber, that is waterproof and high in elasticity. Meanwhile, the back plate 52 is formed from a comparatively hard synthetic resin.

The operating portion 51 has a size adequate for covering a portion corresponding to the switching unit 15, that is, a portion above the switching unit 15 and the opening 35*a* of the case 35. By making the length and width of the operating portion 51 greater than the length and width of the switching unit 15, the operating area is increased in comparison with the area of the pushbutton 17 of the switching unit 15 and the operability is thereby improved. Moreover, the operating portion 51 is formed to be greater in the length in the up/down direction in FIG. 4 than in the length in the left/right direction so that when mounted onto a vehicle, the operating portion 51 is narrow in the width direction of the vehicle and the operability is thereby improved.

The back plate 52 is formed to be plate-like and is adhered onto the back surface of the operating unit 51 so as to cover at least a portion corresponding to the protective walls 30, that is, at least portions above the protective walls 30. The length and width of the back plate 52 are substantially the same as the length and width of the operating portion 51.

Engaging claws 55*a* and 55*b* that respectively engage with the first engagement recess 65 and the second engagement recess 66 are provided at the respective ends of the back plate 52. The engaging claws 55*a* and 55*b* extend toward the back surface and thereafter extend in mutually separating directions. In the present embodiment, a protruding length L3 of the one engaging claw 55*a*, the front end of which extends upward in FIG. 14, is shorter than a protruding length L4 of the other engaging claw 55*b*, the front end of which extends downwards in FIG. 14.

Furthermore, a pressing portion 55*c* is provided at a central portion of the back plate 52 that corresponds to the pushbutton 17 of the switching unit 15. The pressing portion 55*c* has a circular shape in plan view and the center thereof protrudes towards the back surface.

The groove 53 is formed along the periphery of the operating portion 51 and is continuous with the operating portion 51. The groove 53 is recessed downward with respect to the operating portion 51 and is formed to be endless.

The lip 54 is formed along the periphery of the groove 53 and is continuous with the groove 53. The lip 54 protrudes upward with respect to the groove 53, has a semicircular cross section, and is formed to be endless. The height of the lip 54 is substantially the same as the height of the operating portion 51.

The peripheral portion 56 covers a front surface 48*a* of the second plate-like member 48 shown in FIG. 7 and is continuous with the periphery of the lip 54. As shown in FIG. 14, on peripheral portion 56, a first projection 57 is formed along the lip 54. The first projection 57 has a cross section that protrudes in a semicircular form and is formed to be endless.

Figure 3:
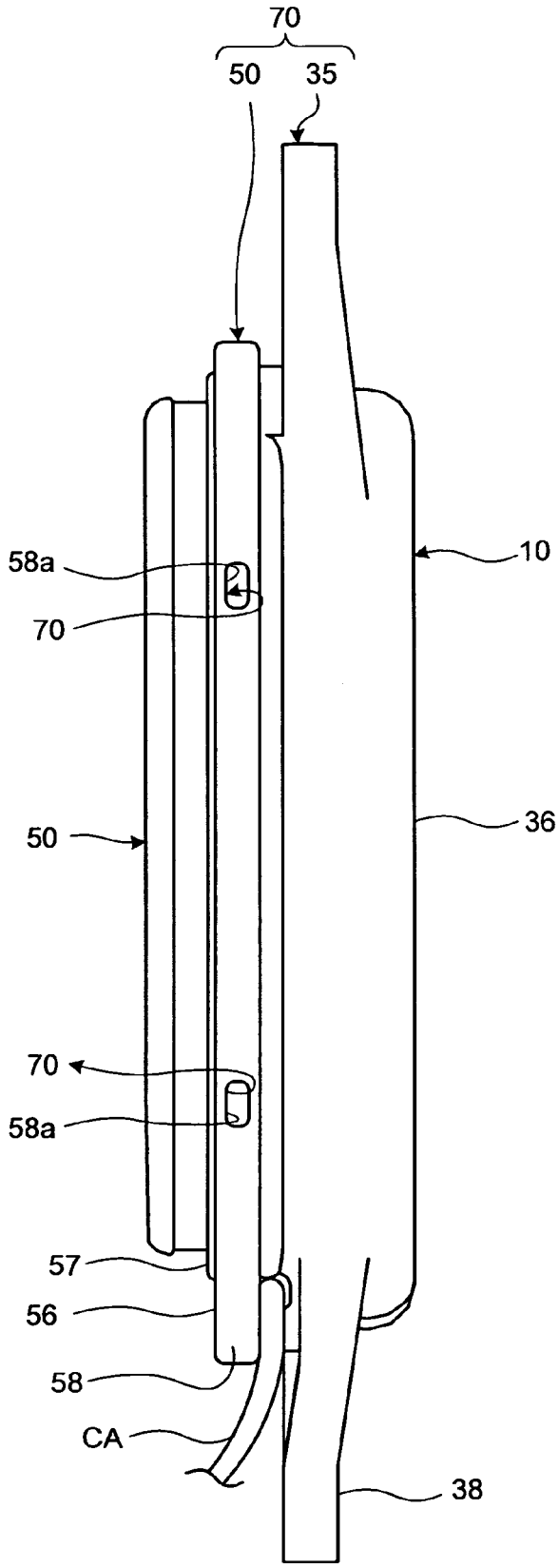
FIG. 3 is a side view of the latch release operating apparatus.

The mounting portion 58 covers a side 48*b* and a back surface 48*c* of the second plate-like member 48 shown in FIG. 7 and is continuous with the peripheral portion 56. As shown in FIG. 14, on mounting portion 58, a second projection 59 is formed along the entire periphery at a portion that covers the back surface 48*c* of the second plate-like member 48. The second projection 59 has a cross section that protrudes in a semicircular form of small diameter and is formed to be endless. Two through holes 58*a* are formed, as shown in FIG. 3, in the mounting portion 58 that is thus arranged. The through holes 58*a* are positioned at locations corresponding to portions at which the breathing grooves 49 of the first plate-like member 47 are formed and have substantially rectangular shapes.

Figure 5:
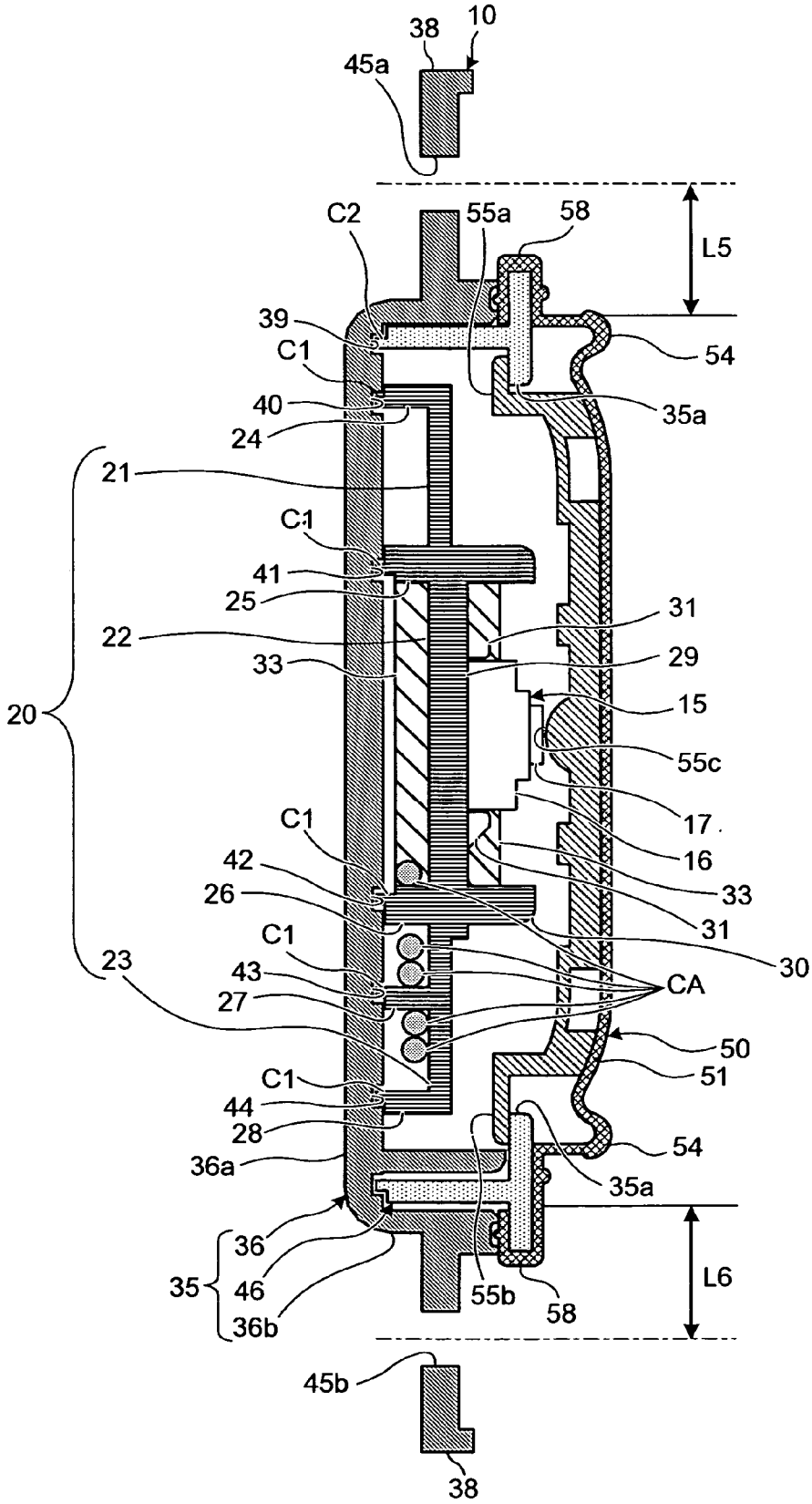
FIG. 5 is a sectional view taken along line I-I of FIG. 4.

To mount the cover 50 that is thus arranged onto the case 35, first, the one engaging claw 55*a* of the back plate 52 shown in FIG. 5 is inserted into the case 35 from one end of the opening 35*a* and the one engaging claw 55*a* and the first engagement recess 65 are engaged. Thereafter, the other engaging claw 55*b* is inserted into the case 35 from the other end of the opening 35*a* and the other engaging claw 55*b* and the second engagement recess 66 are engaged.

The mounting portion 58 of the cover 50 is then inserted between the second plate-like member 48 of the collar 46 shown in FIG. 7 and the side wall 36*b* of the main case body 36 and the second projection 59 is inserted into the engagement groove 36*c* of the main case body 36 to arrange the latch release operating apparatus 10.

Figure 11:
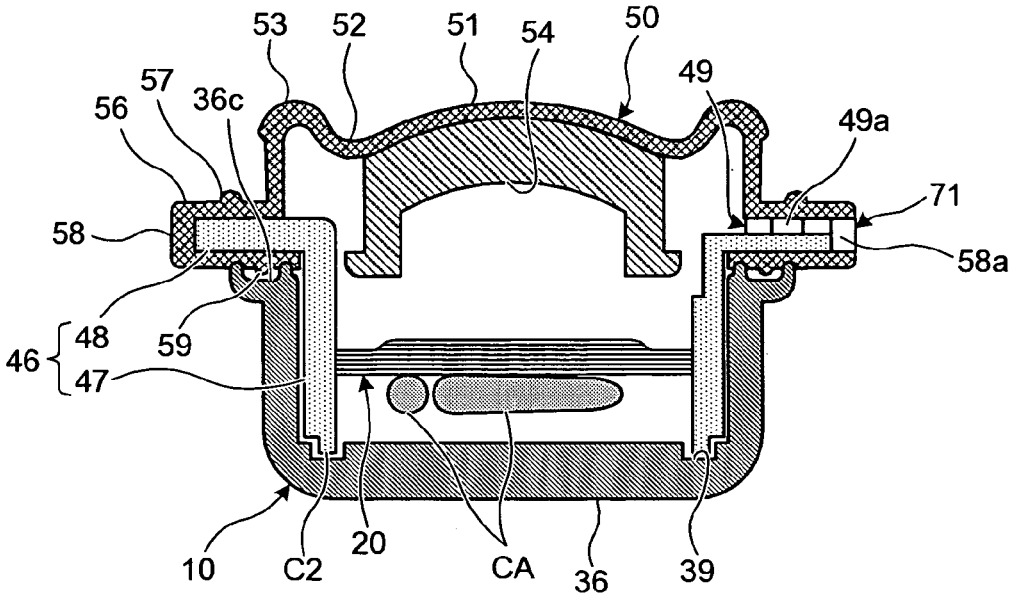
FIG. 11 is a sectional view taken along line IV-IV of FIG. 8.

The latch release operating apparatus 10 includes breathing holes 71 formed by the breathing grooves 49 of the collar 46 and the through holes 58*a* of the cover 50 as shown in FIG. 11. The interior of the enclosure 70 can communicate with its exterior via the breathing holes 71. At the middle of each breathing hole 71 is provided the trap 49*a* that reduces the area of the breathing hole 71.

With the latch release operating apparatus 10, because the protruding length L3 of one of the engaging claws is made shorter than the protruding length L4 of the other engaging claw and the depth D1 of the first engagement recess is made shallower than the depth D2 of the second engagement recess, if the one engaging claw 55*a* is inserted inside the case 35 from the other end of the opening 35*a*, the other engaging claw 55*b* cannot be inserted inside the case 35 because the other engaging claw 55*b* collides with an edge of the first plate-like member 47 of the collar 46. A situation where the breathing holes 71 are not formed due to worker error thus does not arise.

With the latch release operating apparatus 10, when L5 is a distance from the center of the one through hole 45*a* at the upper side in FIG. 5 to one end of the lip 54, and L6 is a distance from the center of the other through hole 45*b* at the lower side in FIG. 5 to the other end of the lip 54, the distance L5 from the center of the one through hole to the one end of the lip is made greater than the distance L6 from the center of the other through hole to the other end of the lip. With the latch release operating apparatus 10, a position determining means is arranged from the through holes 45*a* and 45*b* and the screw holes 13*a* and 13*b*.

To mount the latch release operating apparatus 10 onto the base member 12, the operating portion 51, the groove 53, and the lip 54 are inserted through the mounting opening 12*b* from the inner side of the base member 12 and an upper portion of the peripheral portion 56 is contacted with the inner surface S1 of the base member 12. Then the one screw hole 13*a* is matched with the one through hole 45*a* and the other screw hole 13*b* is matched with the other through hole 45*b*. In this state, screws that have been passed through the through holes 45*a* and 45*b* are screwed into the screw holes 13*a* and 13*b*, respectively, to attach the latch release operating apparatus 10 to the base member 12. Thereafter, the base member 12 is mounted onto the door outer panel P of the trunk lid T. In the state in which the base member 12 is mounted onto the door outer panel P, the breathing holes 71 are positioned at lower portions of the enclosure 70.

In the latch release operating apparatus 10, the distance L1 from the center of the one screw hole to the one end of the mounting hole is greater than the distance L2 from the center of the other screw hole to the other end of the mounting hole, and the distance L5 from the center of the one through hole to the one end of the lip 54 is greater than the distance L6 from the center of the other through hole to the other end of the lip 54. Thus, when the operating portion 51, the groove 53, and the lip 54 are inserted into the mounting opening 12*b* so that the breathing holes 71 are positioned at upper portions of the enclosure 70, the one screw hole 13*a* is not matched with the other through hole 45*b* and the other screw hole 13*b* is not matched with the one through hole 45*a*. The latch release operating apparatus 10 is thus never mounted onto the base member 12 so that the breathing holes 71 are positioned at upper portions of the enclosure 70 due to worker error.

In the latch release operating apparatus 10 thus mounted onto the door outer panel P, when the operating portion 51 of the cover 50 is depressed from the outer side of the door outer panel P, the cover 50 deforms suitably and the pushbutton 17 of the switching unit 15 is depressed and turned on via the operating portion 51. Thus, by connecting a desired cable to the connector CO so that the switching unit 15 functions as a starting switch for a release actuator, the release actuator can be driven according to the depressing of the switching unit 15 to release the latch state of the trunk lid T.

Moreover, in the latch release operating apparatus 10, because the back plate 52 is adhered to the operating portion 51, the depressing of the pushbutton 17 of the switching unit 15 via the operating portion 51 can be performed even by depressing an end of the operating portion 51.

Additionally, in the latch release operating apparatus 10, because the groove 53 is disposed between the operating portion 51 and the lip portion 54, the position of the operating portion 51 can be confirmed readily by touching, for example, with a fingertip and thus without viewing. Thus, even if the latch release operating apparatus 10 is mounted onto the door outer panel P so that the latch release operating apparatus 10 is positioned at an upper portion of the operating recess 12*a* as in the embodiment shown in FIG. 1, operation does not have to be performed upon looking into the operating recess 12*a*.

Furthermore, in the latch release operating apparatus 10, because the length of protrusion of the protective walls 30 with respect to the base plate 20 is made slightly shorter than the length of protrusion of the pushbutton 17 with respect to the base plate 20, the amount of depression of the pushbutton 17 can be restricted by the back plate 52 of the cover 50 contacting the protective walls 30. Thus, damaging of the switching unit 15 can be prevented even if the operating portion 51 of the cover 50 is depressed strongly.

Figure 15:
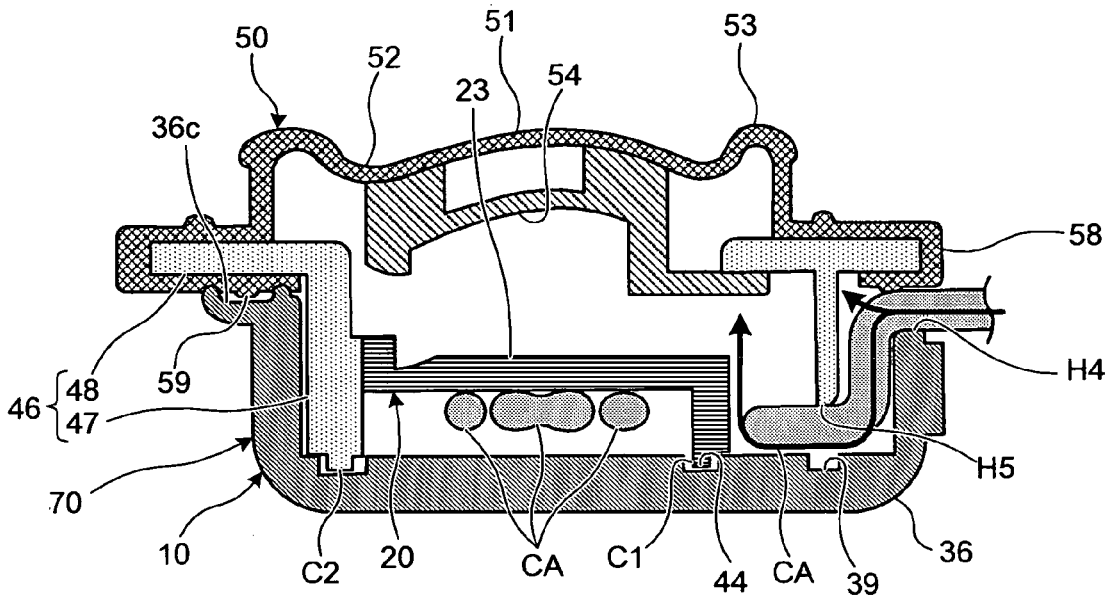
FIG. 15 is a diagram for explaining a path of water that has entered inside an enclosure of the latch release operating apparatus.

Additionally, in the latch release operating apparatus 10, because the sealing members 33 are provided to seal the electrically conducting portions at the front surface and the back surface of the base plate 20, even if water enters inside the enclosure 70, for example, from the cutout H4 of the main case body 36 as shown in FIG. 15, the water is prevented from contacting the electrically conducting portions by the sealing members 33. Malfunction of the latch release operating apparatus 10 due to water contacting the electrically conducting portions thus does not occur.

Figure 16:
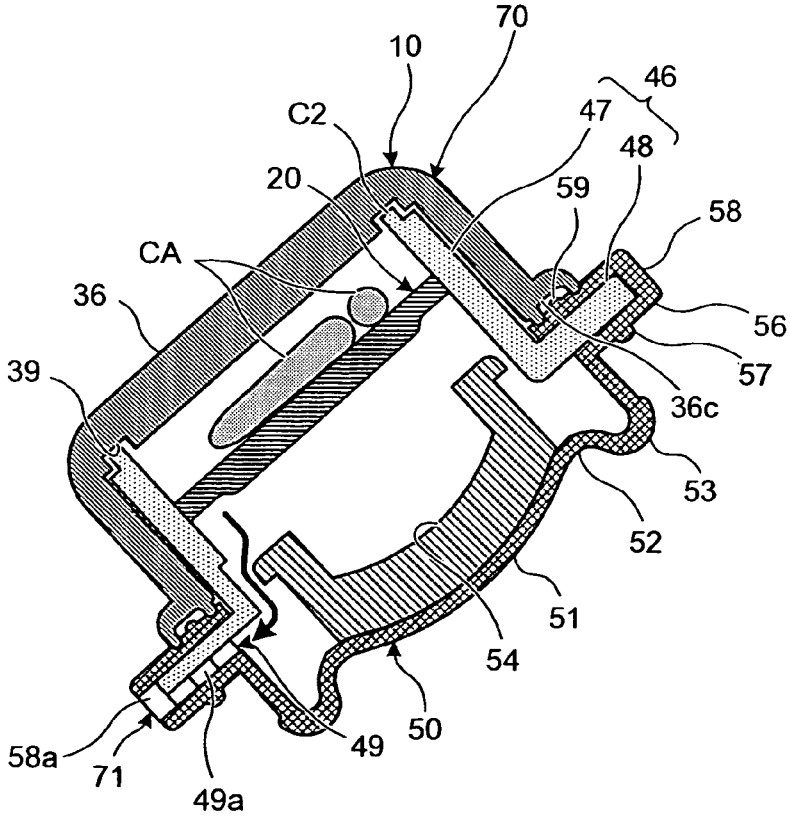
FIG. 16 is a diagram for explaining a path of water that has entered inside an enclosure of the latch release operating apparatus.
Figure 17:
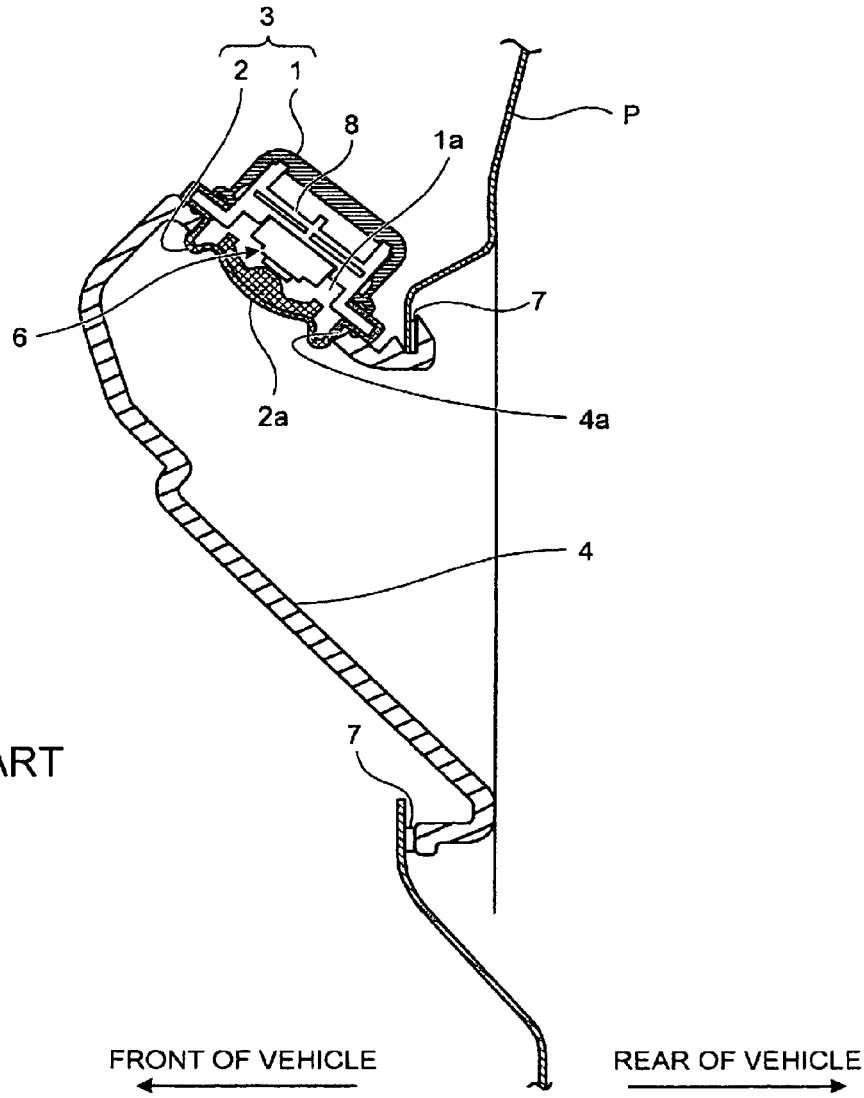
FIG. 17 is a sectional side view of a portion of a vehicle to which a conventional latch release operating apparatus is applied.

Furthermore, in the latch release operating apparatus 10, the breathing holes 71 are positioned at the lower portions of the enclosure 70 so that water that has entered inside the enclosure 70 is drained out of the enclosure 70 by the effect of gravity as shown in FIG. 16. The water that has entered inside the enclosure 70 is thus drained out of the enclosure 70 immediately through the breathing holes 71. The water, thus, does not stay inside the enclosure 70.

Moreover, with the latch release operating apparatus 10, because the traps 49*a* that decrease the areas of the breathing holes 71 are provided at the intermediate portions of the breathing holes 71, the entry of dust and other foreign matter inside the enclosure 70 through the breathing holes 71 can be reduced.

According to the present embodiment, the latch release operating apparatus 10 disposed on the trunk lid T that opens and closes the trunk room of a four-wheel vehicle or other vehicle was explained. However, the present invention is not necessarily restricted thereto and can also be applied to a latch release operating apparatus that releases the latch state of other doors.

Also, though according to the present embodiment, the switching unit 15 has the main switch body 16 with a thin, substantially square outer shape and the pushbutton 17 of thin, cylindrical shape protrudes from the upper surface of the main switch body 16, the arrangement and shape of the switching unit are not restricted thereto. However, a switching unit that is slick is preferable to make the amount of protrusion from the door outer panel P as small as possible.

According to one aspect of the latch release operating apparatus, even if water enters inside the enclosure, the sealing member prevents the water from contacting the electrically conducting portion and a malfunction thus does not occur due to the water that has entered inside the enclosure. Because a packing thus does not have to be disposed between the mounting member and the door outer panel to prevent water from entering inside the enclosure, a latch release operating apparatus that is not limited in installation location and enables diversification of the installation location can be provided. Moreover, the enclosure is provided with the breathing hole that puts the interior of the enclosure and the exterior of the enclosure into communication. Thus, when the air inside the enclosure contracts due to movement of the vehicle from a specific locality to a colder locality, air flows into the interior of the enclosure through the breathing hole and the operational feeling thus does not change. Furthermore, when the vehicle is moved from the specific locality to a warmer locality and the air inside the enclosure expands, because the air is released to the exterior of the enclosure through the breathing hole, the operational feeling does not change.

Moreover, water that has entered into the interior of the enclosure is drained out of the enclosure by the action of gravity and water is thus not retained inside the enclosure.

Furthermore, the latch release operating apparatus can never be mounted due to worker error to the mounting member in a manner such that the breathing hole is positioned at an upper portion of the enclosure.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

This application claims priority from Japanese Patent Application 2005-166744, filed Jun. 7, 2005, which is incorporated herein by reference in its entirety.

What is claimed is:

1. A latch release operating apparatus for releasing a latch state of a door, comprising:

a switching unit having a pressable portion; and an enclosure including:

a case having a hollow portion;

a base plate arranged in the hollow portion, the base plate having an electrically conducting portion;

a member made of electrically non-conducting material arranged at the electrically conducting portion of the base plate; and a cover for closing the hollow portion, wherein at least one of the case and the cover is provided with a breathing hole such that an interior of the enclosure communicates with an exterior of the enclosure, wherein a trap is provided at a middle of the breathing hole to reduce an area of the breathing hole, wherein the cover includes a back plate having a pressing portion, wherein the back plate of the cover includes a first engaging claw and a second engaging claw, wherein a protruding length of the first engaging claw is configured to be shorter than a protruding length of the second engaging claw, wherein the case includes a first engagement recess and a second engagement recess, wherein a depth of the first engagement recess is configured to be more shallow than a depth of the second engagement recess, wherein the first engaging claw is engaged to the first engagement recess before the second engaging claw is engaged to the second engagement recess, and wherein, when the cover is pressed, the back plate is configured to move toward and push the pressable portion of the switching unit in order to send a signal for releasing the latch state of the door.

2. The latch release operating apparatus according to claim 1, wherein the breathing hole is positioned at a portion that is towards ground when the enclosure is arranged at its appropriate position.

3. The latch release operating apparatus according to claim 2, further comprising a position determining arrangement arranged between the cover and a mounting member for mounting the latch release operating apparatus in the appropriate position, wherein the position determining arrangement includes matching screw holes and through holes.

4. A latch release operating apparatus for releasing a latch state of a door, comprising:

a switching unit having a pressable portion; and an enclosure including:

a case having a hollow portion;

a base plate arranged in the hollow portion, the base plate having an electrically conducting portion;

a member made of electrically non-conducting material arranged at the electrically conducting portion of the base plate; and a cover for closing the hollow portion, wherein both of the case and cover are provided with a breathing hole such that an interior of the enclosure communicates with an exterior of the enclosure, wherein a breathing groove is provided on a collar of the case, wherein a through hole is provided on the cover, wherein the breathing groove and the through hole are arranged such that the breathing groove coincides with the through hole to form the breathing hole, wherein the cover includes a back plate having a pressing portion, wherein the back plate of the cover includes a first engaging claw and a second engaging claw, wherein a protruding length of the first engaging claw is configured to be shorter than a protruding length of the second engaging claw, wherein the case includes a first engagement recess and a second engagement recess, wherein a depth of the first engagement recess is configured to be more shallow than a depth of the second engagement recess, wherein the first engaging claw is engaged to the first engagement recess before the second engaging claw is engaged to the second engagement recess, and wherein, when the cover is pressed, the back plate is configured to move toward and push the pressable portion of the switching unit in order to send a signal for releasing the latch state of the door.

* * * * *